US005253718A

United States Patent [19]

Lawler

[11] Patent Number: 5,253,718

[45] Date of Patent: Oct. 19, 1993

[54] WELLBORE MINERAL JETTING TOOL

[75] Inventor: O. Wayne Lawler, Humble, Tex.

[73] Assignee: Seacoast Services, Inc., Houston, Tex.

[21] Appl. No.: 7,796

[22] Filed: Jan. 22, 1993

Related U.S. Application Data

[62] Division of Ser. No. 790,217, Nov. 8, 1991, Pat. No. 5,181,578.

[51] Int. Cl.[5] ..... E21B 10/00

[52] U.S. Cl. ..... 175/20; 175/67; 175/424

[58] Field of Search ..... 175/339, 340, 393, 424, 175/67, 20

[56] References Cited

U.S. PATENT DOCUMENTS

| | | | |
|---|---|---|---|
| 3,030,086 | 4/1962 | Donaldson et al. | 175/424 X |
| 3,142,339 | 7/1964 | Brown et al. . | |
| 4,027,407 | 6/1977 | Kiss | 175/424 X |
| 4,134,619 | 1/1979 | Bunnelle . | |
| 4,140,346 | 2/1979 | Barthel . | |
| 4,534,427 | 8/1985 | Wang et al. | 175/67 |
| 4,919,204 | 4/1990 | Baker et al. | 175/424 X |

*Primary Examiner*—Thuy M. Bui

*Attorney, Agent, or Firm*—Richard C. Litman

[57] ABSTRACT

A wellbore jetting tool has a novel packer assembly which enables the tool to be raised, lowered and rotated while operating, a nozzle which automatically raises to extend radially from the tool, and a flow system for returning slurry in an inner tube of cross section. The packer assembly is hydraulically actuated, and traps fluid to provide lubrication, which enables raising, lowering and rotation during operation while substantially maintaining the necessary sealing. The nozzle is raised by a torque generated by vanes disposed within the nozzle head reacting to fluid flow, and also by thrust from the cutting jet. The nozzle discharges this jet at an angle, thus biasing the nozzle appropriately. A breakaway feature allows abandonment of the nozzle if it jams when it is extended, ensuring that the pipestring may always be retrieved. The return of slurry through its own conduit reduces chances of a particle lodging in the slurry return line.

12 Claims, 4 Drawing Sheets 2
3
9
19
10
4
5
13
6
7
7a
18
12
7b
13
8
22
7b
24
11
17
20
24
26
28
16
64
76
66
11
71
80
78
78
11

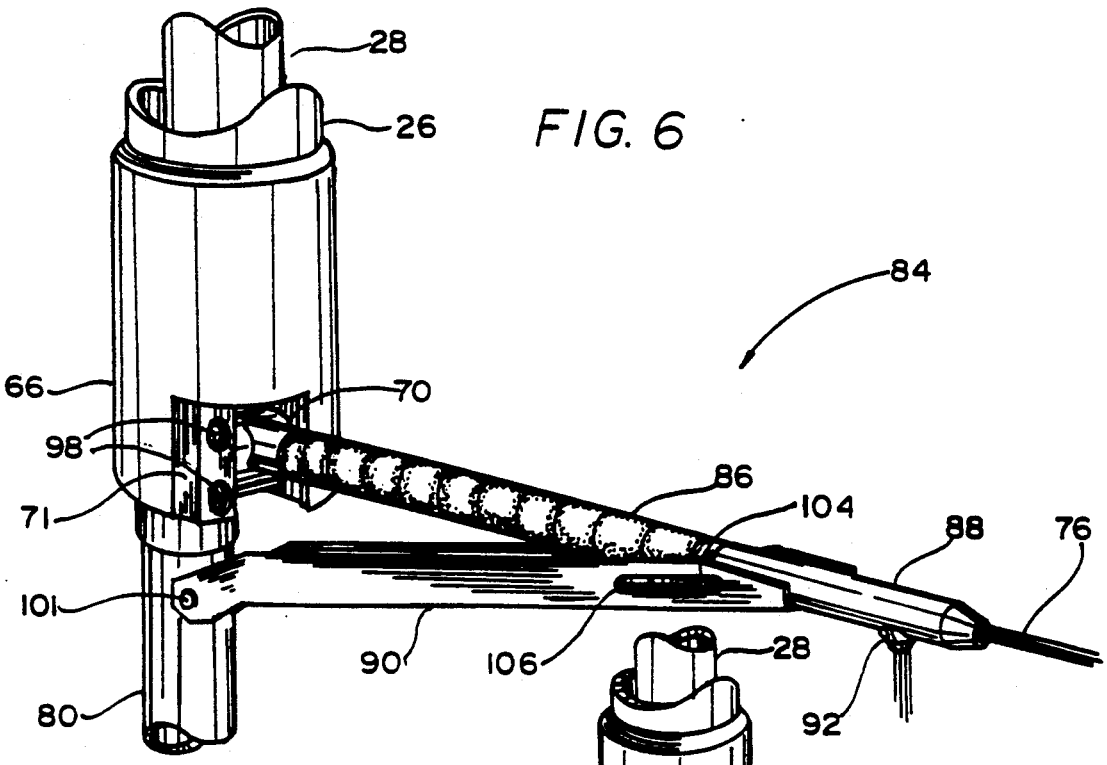
FIG. 6
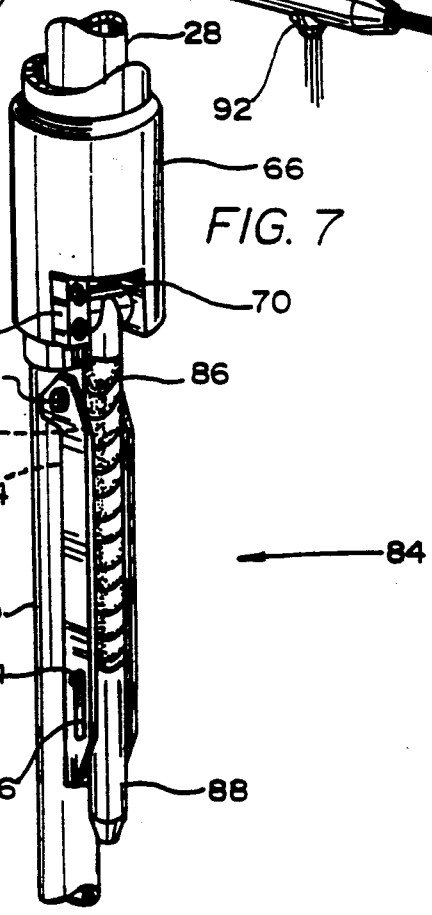
FIG. 7
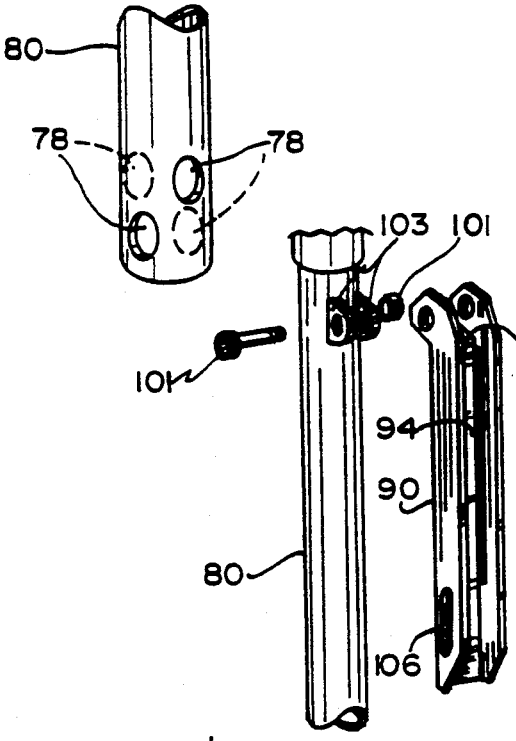
FIG. 8
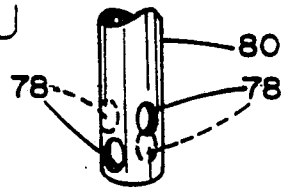

WELLBORE MINERAL JETTING TOOL

CROSS REFERENCE TO RELATED APPLICATION

This is a divisional application of U.S. patent application Ser. No. 07/790,217, filed on Nov. 8, 1991, now U.S. Pat. No. 5,181,578.

FIELD OF THE INVENTION

The present invention relates to a wellbore jetting tool, and more particularly to a comminuting and slurry collecting tool located at the lower end of a pipestring.

BACKGROUND OF THE INVENTION

Downhole mining tools which provide jet disintegration and excavation of a mineral deposit and collection of the resultant slurry are well known, as exemplified by U.S. Pat. No. 4,140,346, issued to Ronald Barthel on Feb. 20, 1979. Generally, this type of tool uses an eductor pump, also popularly known as a jet pump, to provide necessary lift to bring the slurry to the surface. Also, a cutting jet directed laterally comminutes and slurrifies the mineral deposit. The eductor evacuates the excavated chamber as it gathers the slurry, so that the cutting jet flows through a gas medium, in most cases the gas being air.

A severe limitation of the eductor lift system, however, is that there is a maximum depth at which the eductor provides lift. Typically, eductor systems are limited to a depth of approximately 600 feet. While the depth range of eductor systems may be extended as by compounding the eductor with auxiliary lift methods, this entails additional complexity and expense.

Another limitation of eductor systems is that the roof of the excavated chamber tends to collapse as the chamber horizontal diameter increases. This limits the ability of a single borehole rig to exploit the mineral deposit.

A further drawback to eductor systems is that for proper control of the cutting and lifting functions, separate pumps are required to vary the flow and pressure of fluid supplied. Furthermore, separate conduits serving the cutting jet supply, lift jet supply, and slurry return may also be required. Containing three conduits within a single borehole casing devotes excessive cross sectional area to conduit sidewalls, thereby reducing the effective conduit area, increasing the attendant pressure losses due to sidewall friction, and increases the cost of construction. The reduced conduit cross section also increases the chances of a jam by large, uncomminuted particles in the slurry return line.

Therefore, a tradeoff is made between desired control and reduced power requirements. Illustratively, Barthel uses only two conduits; however, his arrangement forgoes adjustment of flow for cutting or lift relative to flow for the other function.

Packers for sealing the annulus between concentric tubes are known in the mineral drilling arts. An example of a hydraulically actuated packer is U.S. Pat. No. 3,142,339, issued on Jul. 28, 1964 to C. C. Brown et al. Prior art packers are generally intended to provide a tight seal or a tight grip between tubes.

A national trend towards depletion of easily recovered shallow mineral deposits makes it desirable to adapt borehole mining to deep hole applications. In the face of the above cited limitations and costs, even as boreholes are drilled deeper, economic necessity makes it imperative to render each borehole rig more productive and less costly.

SUMMARY OF THE INVENTION

By the present invention, an improved wellbore jetting tool is provided which operates at great depths, which overcomes the problem of roof collapse, and which requires only a single pressure pump to achieve satisfactory operation.

The wellbore jetting tool of the present invention comprises a vertically disposed tube attached to the lower end of an otherwise conventional pipestring. A novel well packer assembly disposed at the top of the tool diverts flow of pressurized fluid into the tool and seals the annulus between the tool and the borehole casing leading to the chamber below. Packer operation responds to the presence of fluid pressure. The packer maintains the seal while permitting raising, lowering, or rotation of the tool during operation.

Fluid injected under high pressure by the cutting jet fills the excavated chamber with fluid, supporting the chamber roof. By simple pressure differential, the slurry is transported to the ground surface through a slurry tube carried within the tool and within the casing above the tool. Suction, or negative pressure, based eductor lift is thereby replaced by a high, or positive, pressure system.

A nozzle directing the cutting jet extends itself laterally to maintain proximity of the exit orifice of the nozzle with the wall of the mineral deposit. This proximity maintains the effective pressure of the cutting jet in the presence of fluid filling the excavated chamber.

The short, single part nozzle of one embodiment may be replaced by a longer tube and sleeve extended nozzle of a second embodiment. The variable, long reach thereby achieved permits drilling a single borehole to exploit an extensive mineral deposit.

Effectiveness of the cutting jet is thus preserved while slurry transport pressure is maintained. The tool may be used with conventional wellbore rigs, thus enabling a user to purchase or rent conventional, "off-the-shelf" rig and pipestring components. The rig may even be simplified by the use of a singular pressure pump and by the presence of only a singular tube (the slurry tube) within the casing above the tool.

Accordingly, an object of the present invention is to provide a wellbore jetting tool providing slurry lift by positive fluid pressure so that the system is operable at any drilling depth.

A second object is to provide a wellbore jetting tool which requires only two conduits communicating with the above ground rig to operate.

A third object is to provide a packer assembly sealing the annulus above the tool between the slurry tube and the casing, whereby this annulus becomes useful as a conduit for the supply of downflowing pressurized water, thus maximizing the utilized cross sectional area of the casing.

A fourth object is to provide a packer assembly which maintains the seal described above effective during mining operation, which may include raising, lowering, or rotating of the tool under full fluid pressure.

Another object is to provide a wellbore jetting tool which provides support to the roof of an excavated chamber.

Yet another object is to provide a wellbore jetting tool having a selectively radially extensible cutting nozzle whereby the cutting nozzle may be retracted to fit within the casing for installation and recovery.

An additional object is to provide a wellbore jetting tool having a radially extensible cutting nozzle whereby introduction of pressurized fluid urges the extensible cutting nozzle into an operative extended orientation.

Still another object is to provide a wellbore jetting tool having a selectively variable reach nozzle, so that the reach may be periodically adjusted to cooperate with the progressively widened chamber.

A further object is to provide a wellbore jetting tool having a radially extensible cutting nozzle which cutting nozzle may be readily severed from the tool and abandoned in the event of the inability of the cutting nozzle to retract.

A still further object is to provide a wellbore jutting tool providing a central slurry conduit of maximal diameter, thus lessening the likelihood of a large fragment of mineral to jam the conduit.

Another object is to provide a wellbore jetting tool which works with an otherwise conventional borehole rig, whereby most components are readily accessible at reasonable cost.

With these and other objects in view which will more readily appear as the nature of the invention is better understood, the invention consists in the novel construction, combination, and assembly of parts hereinafter more fully described, illustrated and claimed with reference being made to the attached drawings.

BRIEF DESCRIPTION OF THE DRAWINGS

FIG. 6 is a partial perspective detail view drawn to enlarged scale of a second embodiment of the tool showing the cutting jet nozzle assembly in an extended position.

FIG. 7 is a partial perspective detail view drawn to enlarged scale of a second embodiment of the tool showing the cutting jet nozzle retracted.

FIG. 8 is an exploded partial detail view of the cutting jet nozzle assembly of the second embodiment showing the mounting of the arm to the tool.

Similar reference characters designate corresponding parts throughout the several figures of the drawings.

DESCRIPTION OF THE PREFERRED EMBODIMENTS

Figure 1:
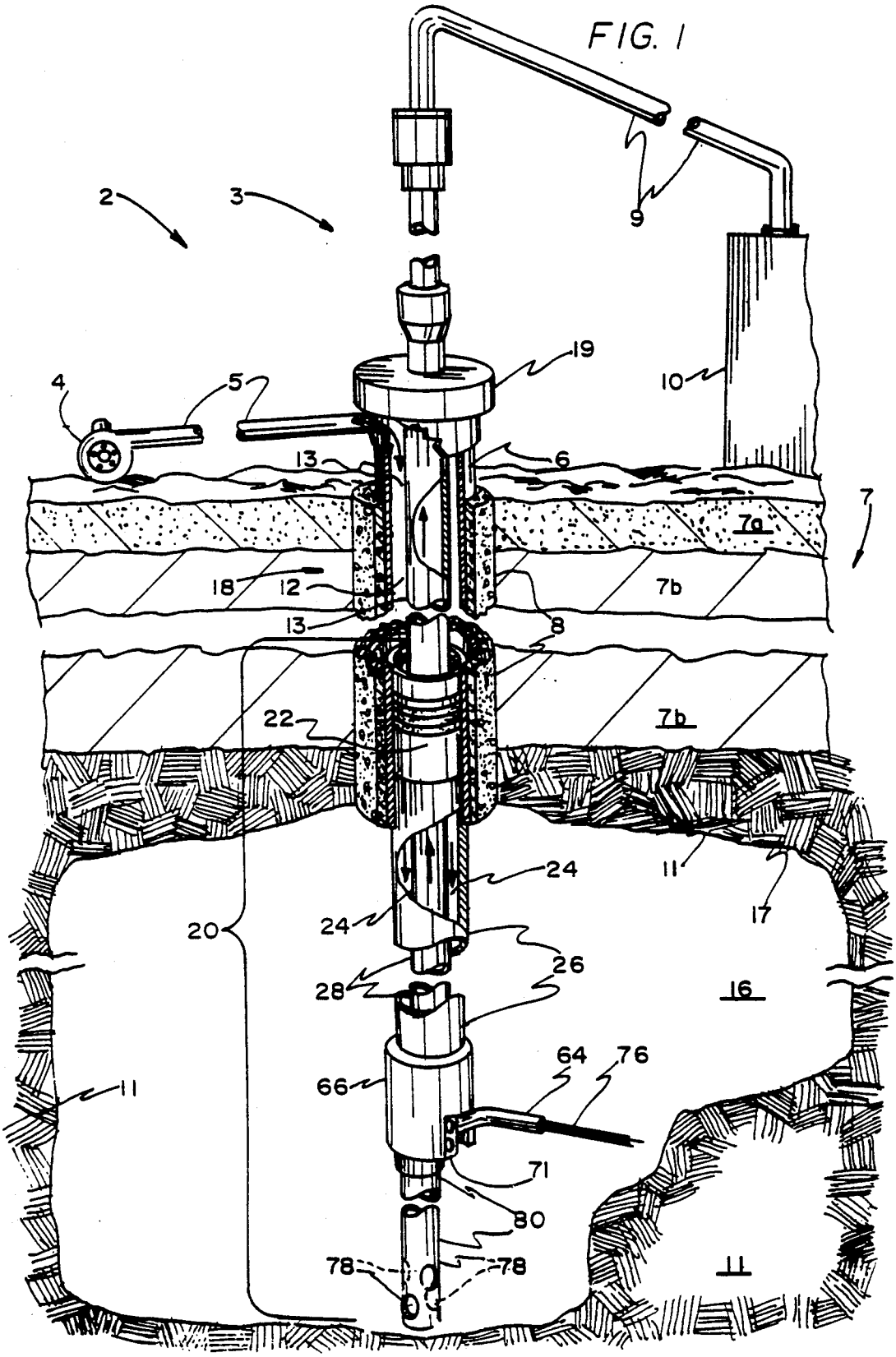
FIG. 1 is a perspective view of the invention as installed on a drilling rig set up in a drilled and cased borehole.

The wellbore jetting tool 20 (hereinafter referred to as "tool") of the present invention is seen in FIG. 1 to comprise the lowest component of a pipestring 2 used in a borehole mining rig 3. The borehole mining rig 3 includes a pump 4, a power swivel 19, a conduit 5 bringing fluid discharged at high pressure from the pump, and ground components including a casing 6 penetrating the ground 7, which ground 7 typically comprises several strata *7a,7b*, a cement layer 8 securing the casing 6 to the surrounding ground 7, and a conduit system 9 conveying recovered mined product to storage 10. Excepting the tool 20, all previously recited components are conventional in borehole mining.

The tool 20 disintegrates a mineral deposit 11 disposed among ground strata *7a,7b*, slurrifies the comminuted mineral 11 , collects the resultant slurry, and transports the slurry to the conduit system 9 leading to a storage facility 10. Storage facilities 10 typically contain settling ponds (not shown) or similar apparatus to separate the recovered mineral from the fluid, typically water, used in the mining operation. Mining fluid is usually reclaimed, and recirculated.

A conduit 5 carrying fluid from the pump 4 discharges the fluid into the casing 6. As indicated by arrows, the fluid flows downwardly in an annulus 12 defined between the casing 6 and an inner tube 13, this inner tube 13 returning recovered slurry to the storage facility 10.

Figure 2:
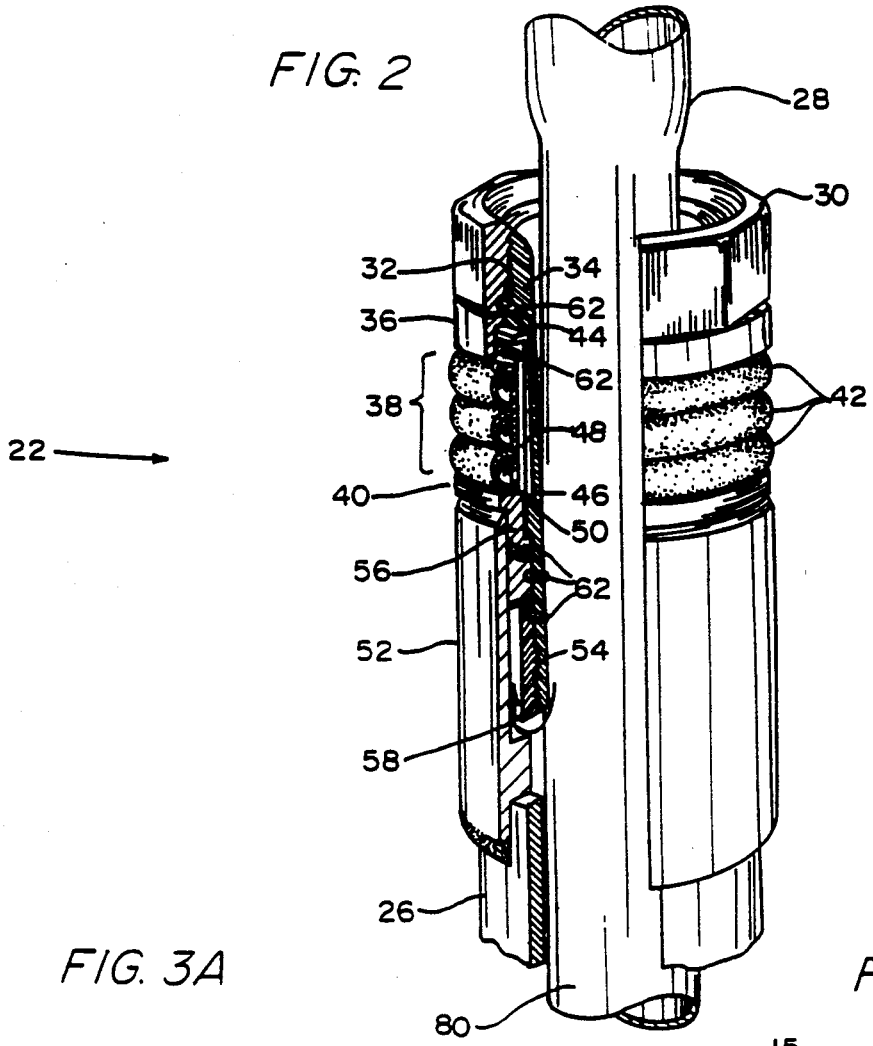
FIG. 2 is a partial cross section detail drawn to enlarged scale of the tool showing the packer assembly in a relaxed state.

The packer assembly 22 diverts this fluid into a conduit 24 defined in the tool 20 between the tool outer tube 26 and the slurry tube 28. Better seen in FIG. 2, the packer assembly 22 comprises a retention nut 30 which attaches by mutual threading 32 to a packer sleeve 34. Concentric with the slurry tube 28 and exterior to the packer sleeve 34 are, respectively, an upper compression ring 36 located directly beneath the retention nut 30, a resilient packer ring 38, and a lower compression ring 40. The packer ring 38 has resilient members 42 which distend outwardly in the manner of stacked rubber inner tubes, as are used in pneumatic, tires.

A bushing 44 is disposed between the packer sleeve 34 and the surrounding upper compression ring 36 and packer ring 38. A lowermost portion 46 of the bushing skirt 48 rides in a gap 50 defined between the lower compression ring 40 and the packer sleeve 34.

An adaptor housing 52, rigidly connected to the tool outer tube 26 as by welding, is secured to the packer sleeve 34, again by mutual threading 54. The adaptor housing 52 retains the lower compression ring 40 in an annular chamber 56 defined by the adaptor housing 52, the packer sleeve 34, and the packer ring 38. The lower compression ring 40 is able to move axially along the packer sleeve 34, thus compressing the resilient packer ring 34.

Figure 3A:
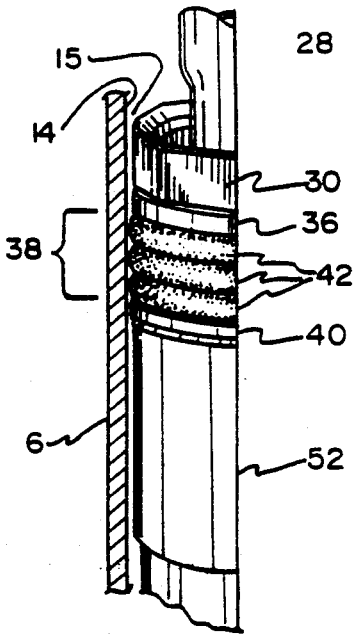
FIG. 3A is a partial perspective detail drawn to enlarged scale of the packer assembly in a relaxed state.
Figure 3B:
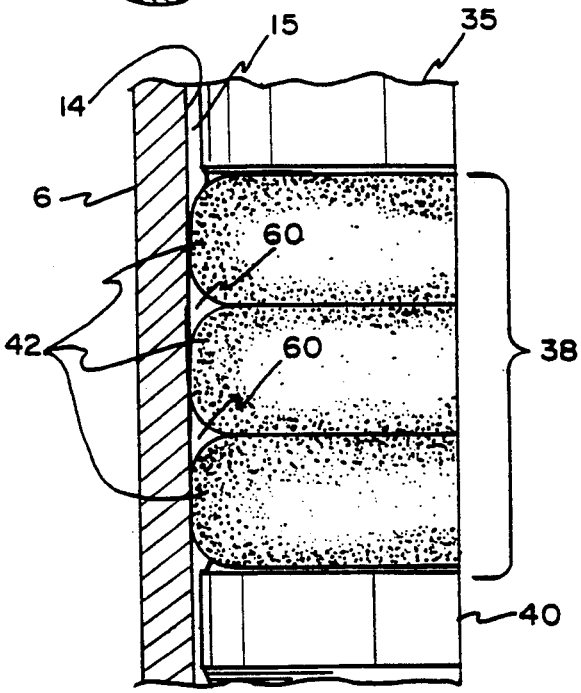
FIG. 3B is a partial perspective detail drawn to enlarged scale of the packer ring in a distended condition.

A pressure port 58 disposed in the adaptor housing 52 conducts pressure from pressurized fluid flowing in the conduit 5 leading to the casing interior 13. This pressurized fluid exerts a force on the lower compression ring 40, forcing the lower compression ring 40 to move upwardly and thereby compress the packer ring 38. As shown in FIG. 3B, the packer ring 38 distends outwardly upon this compression, contacting and sealing the casing inner surface 14.

Since fluid under pressure contacts the tool 20 prior to this seal being effected, some fluid slips past the packer ring 38 between the tool 20 and the casing 6. FIG. 3A shows the unsealed gap 15 existing in the absence of fluid pressure between the casing 6 and the tool 20. Upon packer ring distension, some of this fluid is trapped in valleys 60 formed in the packer ring 38. The trapped fluid lubricates the contact between the packer ring 38 and the casing 6 so that the tool 20 may be raised, lowered, or rotated even while operating under full fluid pressure. Raising, lowering and rotating the tool 20 are performed by well known equipment (not shown) located above ground, as described and illustrated in U.S. Pat. No. 4,077,481, issued to Philip R. Bunnelle on Mar. 7, 1978. Pressurized fluid is sealed to preclude escape by O-rings 62.

Figure 4:
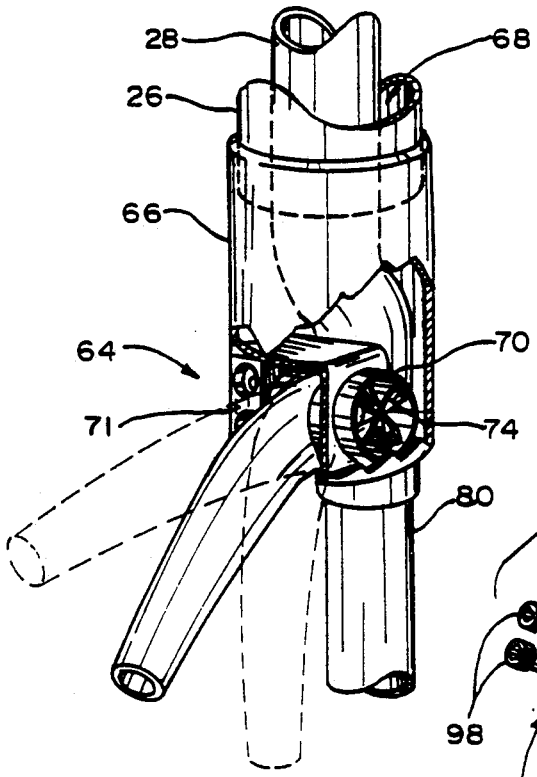
FIG. 4 is a partial cross sectional detail drawn to enlarged scale of a first embodiment of the cutting jet nozzle assembly.

A cutting jet nozzle 64 is disposed at the lower end 66 of the tool 20. As seen in FIG. 4, this cutting jet nozzle 64 may assume any position within a 90 degree arc between vertical and horizontal with respect to the tool axis. The cutting jet nozzle 64 points straight down, in vertical orientation to the tool axis, in the absence of fluid pressure, due to a bias produced by a spring 67 engaging the cutting jet nozzle 64 and the tool outer tube 26. The reduced overall tool diameter thus obtained when the cutting jet nozzle 64 is inactive permits insertion of the tool 20 into the casing 6 for installation or retrieval.

Figure 5:
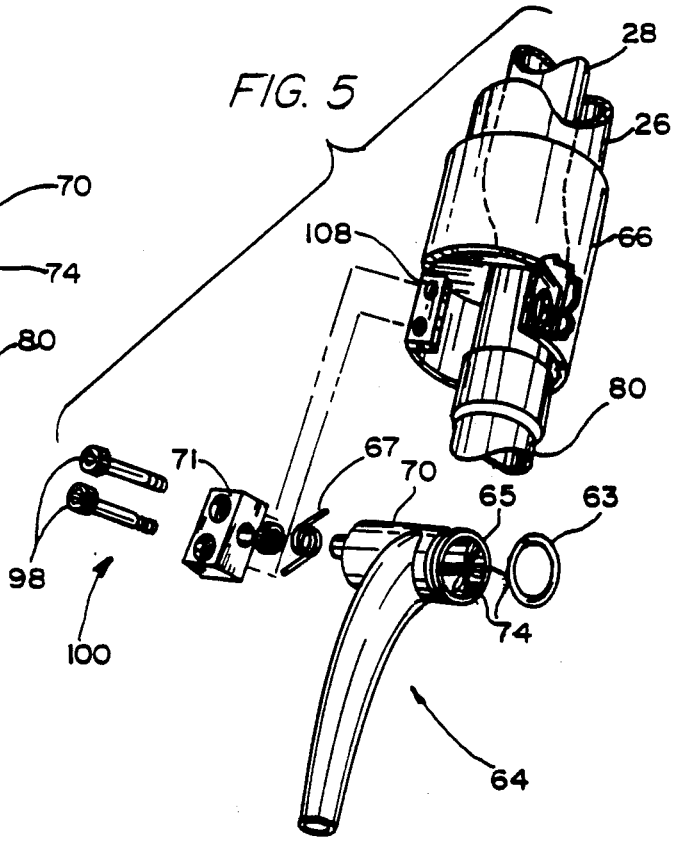
FIG. 5 is an exploded detail drawn to enlarged scale of a first embodiment of the cutting jet nozzle assembly.

Introduction of fluid under pressure from the pump 4 above causes the cutting jet nozzle 64 to project horizontally, also shown in FIG. 4. Fluid flowing downwardly in the annulus 68 between the tool outer tubing 26 and the slurry tube 28 first enters a horizontal tube 70 communicating with the cutting jet nozzle 64. The horizontal tube 70 is pivotally mounted on a supporting block 71, and sealed by an O-ring 63 on a side 65 contacting the tool outer tube 26. The fluid encounters vanes 74 oriented to produce a torque acting on the cutting jet nozzle 64 in response to the entering flow. This torque acts in a direction tending to elevate the cutting jet nozzle 64 into a horizontal position. FIG. 5 illustrates the construction of the cutting jet nozzle 64.

The tendency to elevate provided by the vanes 74 is reinforced by the attitude of fluid discharge. Offset from the axis of the tool 20, and directed downwardly but to a small degree opposite the direction of elevation, the cutting jet nozzle 64 is further urged into a horizontal position by thrust from pressurized fluid.

The cutting jet nozzle 64 then directs a jet 76 of pressurized fluid against the mineral deposit 11. The force of this jet 76 disintegrates the mineral 11, suspending it in a slurry, and creating a progressively larger cavity 16 in the mineral deposit 11. Continuous discharge from this jet 76 fills the cavity 16 with fluid under pressure. The pressure both supports the roof 17 of the cavity 16 and forces the slurry into ports 78 located at a bottom section 80 of the slurry tube 28. The slurry rises in the slurry tube 28 to the ground surface above under the influence of this pressure, whereupon the mineral 11 is separated from the fluid.

The tool 20 is suitably rotated while operating to extend the cavity 16 radially. The tool 20 may also be raised and lowered to extend the cavity 16 vertically. When disintegration of the mineral deposit 11 ceases and the slurry comprises primarily fluid, as may be determined by examining the slurry above ground, the mining operation is suspended.

If the slurry exhibits continued but dilute mineral content, and it is therefore apparent that the mineral deposit 11 is not exhausted, but now lies outside the reach of the cutting jet 76, the tool 20 may be retrieved and modified according to a second embodiment. In this second embodiment, seen in FIG. 6, the original cutting jet nozzle 64 has been removed from the tool 20, and an extension 84 attached in its place.

The extension 84 comprises a flexible hose 86, a nozzle tip 88 and a supporting arm 90. In this embodiment, a thrust nozzle 92 is located on the cutting jet nozzle 88 to discharge horizontally when the cutting jet nozzle 88 is in the stowed position. Thrust obtained upon introduction of pressurized fluid urges the cutting jet nozzle 88 into the deployed position. This deployed position is illustrated in FIG. 7. The supporting arm 90 is U-shaped in cross section. The central webbing 94 of the U is configured to interfere with the tool bottom section 80 when the cutting jet nozzle 88 is horizontal. The stop 96 thus created, and best shown in FIG. 8, limits elevation of the cutting jet nozzle 88 to perpendicularity with the tool central axis.

The extension 84 thus extends the reach of the tool 20 so that a mineral deposit 11 not exhausted by the shorter nozzle 64 of the first embodiment may be exploited using the original cased borehole 18.

From time to time, a large object may lodge between the cutting jet nozzle 64 or 84 and the tool outer tubing 26, preventing the return of the cutting jet nozzle 64 or 84 to its stowed position. The cutting jet nozzle 64 or 84 may be detached and abandoned, and the tool 20 and pipestring 2 may still be retrieved from the borehole 18.

The cutting jet nozzle 64 or 84 is secured within the tool outer tubing 26 by frangible fasteners 98 such as plastic bolts 100 to a lip 108. Upon being pulled up during retrieval of the pipestring 2 or during maneuvering of the tool 20, if the cutting jet nozzle 64 or 84 is prevented from returning, the frangible fasteners 98 yield and the trapped cutting jet nozzle 64 or 84 is disengaged from the tool 20. The tool 20 and pipestring 2 may then be retrieved in the usual way.

The supporting arm 90 of the second embodiment pivots on two frangible fasteners 101 and is also abandoned with the cutting jet nozzle 84 responsive to the tool 20 being withdrawn from the borehole 18. FIG. 8 illustrates engagement of the frangible fasteners 101 with projections 103 mounted on the bottom section 80 of the tool 20.

In the second embodiment, a short peg 104 projects from the cutting jet nozzle 84 to ride in a slot 106 in the supporting arm 90. Correct orientation of the thrust nozzle 92 is thus maintained. Also, the hose 86 and cutting jet nozzle 84 are thus retained within the U-shaped supporting arm 90.

It is to be understood that the present invention is not limited to the sole embodiments described above, but encompasses any and all embodiments within the scope of the following claims.

I claim:

1. A wellbore mining comminuting and collecting tool for use with, and installed at the lower end of, a drilling pipestring having a longitudinal axis, the pipestring being inserted into a predrilled and cased vertical hole, said comminuting and collecting tool comprising a first and a second tube wherein pressurized fluid flows from a source above ground through the pipestring into one of said first and second tubes, and a slurry created by discharge of said pressurized fluid is collected and conducted above ground in the other of said first and second tubes, said comminuting and collecting tool further comprising a cutting jet nozzle means extensible from said comminuting and collecting tool at an angle whereby a jet of pressurized fluid discharged axially from said jet nozzle means is directed against surrounding mineral deposits at said angle from said vertical hole, and pressure from said jet lifts said slurry and also supports a roof of a chamber defined in a geological formation by hydraulic comminution and collection, and said tool assumes dimensions sufficiently small to fit into the cased hole by retraction of said jet nozzle upon cessation of flow of pressurized fluid.

2. The invention as claimed in claim 1, said cutting jet nozzle means further comprising coupling and uncoupling means, whereby a nozzle may be replaced by another nozzle.

3. The invention as claimed in claim 1, said cutting jet nozzle means further comprising detachment means actuated from above ground whereby said jet nozzle means may be detached from said tool in the event of inability of said jet nozzle means to retract.

4. The invention as claimed in claim 1, said cutting jet nozzle means further comprising a solid tube being mounted offset from said pipestring axis, and further discharging said jet at an angle to said axis, whereby introduction of fluid pressure urges said cutting jet nozzle means, and therefore said jet, from a substantially parallel orientation with respect to said pipestring to an angled orientation.

5. The invention as claimed in claim 1, said cutting jet nozzle means comprising a housing defining an inlet and a passageway thereof having fluid reaction surfaces projecting thereinto, whereby introduction of said pressurized fluid imparts a torque, said torque urging said cutting jet nozzle means from a substantially parallel orientation with respect to said pipestring to an angled orientation.

6. The invention as claimed in claim 5, said fluid reaction surfaces comprising vanes.

7. The invention as claimed in claim 2, said cutting jet nozzle means further comprising a housing defining an inlet and a passageway thereof having fluid reaction surfaces projecting thereinto, whereby introduction of said pressurized fluid imparts, a torque, said torque urging said cutting jet nozzle means from a substantially parallel orientation with respect to said pipestring to an angled orientation.

8. The invention as claimed in claim 1 said first tube being disposed within said second tube, an annulus thus being defined between said first and second tubes, wherein said pressurized fluid flows down from the source in said annulus and said slurry flows upwardly in said first tube.

9. The invention as claimed in claim 1 , said first tube being disposed within said second tube, an annulus thus being defined between said first and second tubes, wherein said pressurized fluid flows down from the source in said first tube and said slurry flows upwardly in said annulus.

10. The invention as claimed in claim 7, said first tube being disposed within said second tube, an annulus thus being defined between said first and second tubes, wherein said pressurized fluid flows down from the source in said annulus and said slurry flows upwardly in said first tube.

11. The invention as claimed in claim 7, said first tube being disposed within said second tube, an annulus thus being defined between said first and second tubes, wherein said pressurized fluid flows down from the source in said first tube and said slurry flows upwardly in said annulus.

12. The invention as claimed in claim 2, further comprising a support bar or arm pivotally mounted on said tool and supporting said cutting jet nozzle means.

* * * * *